US005743797A

United States Patent [19]

Jannersten

[11] Patent Number: 5,743,797

[45] Date of Patent: Apr. 28, 1998

[54] DEVICE FOR CONTROLLING, PRESENTING AND REGISTERING THE BIDDING IN A GAME OF BRIDGE

[76] Inventor: Per Jannersten, Banérgatan 15, S-752 37 Uppsala, Sweden

[21] Appl. No.: 653,250

[22] Filed: May 24, 1996

[51] Int. Cl.[6] ..... A63F 1/00

[52] U.S. Cl. ..... 463/11; 463/37

[58] Field of Search ..... 463/11, 22, 37, 463/40, 47

[56] References Cited

U.S. PATENT DOCUMENTS 4,030,764 6/1977 Mattos ..... 463/47

4,373,719 2/1983 Nelson et al. ..... 463/11

5,397,133 3/1995 Penzias ..... 463/22

*Primary Examiner*—George Manuel

*Attorney, Agent, or Firm*—Young & Thompson

[57] ABSTRACT

A device for registering and presenting bidding in a game of bridge comprises a computer unit (1–5) which includes at least one bid-entering keyboard (2–5), elements for comparing the entered bid with bids permitted by the rules of bridge, elements for preventing impermissible bids being presented, elements (1) for registering entered bids, and elements for presenting or displaying the entered bid.

5 Claims, 2 Drawing Sheets

DEVICE FOR CONTROLLING, PRESENTING AND REGISTERING THE BIDDING IN A GAME OF BRIDGE

FIELD OF THE INVENTION

The present invention relates to a device for controlling, presenting and registering the bidding in a game of bridge.

BACKGROUND OF THE INVENTION

In competitive bridge, e.g. bridge tournaments, each pair is normally issued with a bidding box which contains a bid player card for each of the thirty-five bids that can be called, together with pass, double and redouble cards and also other cards pertaining to recommended bridge rules, such as alert and stop cards. Although bidding with the aid of bidding boxes normally works well, such boxes are not able to prevent bidding which contravenes the rules, i.e. bidding out of turn or bidding too low. There is therefore a need for a bidding device, or system, that will prevent bidding which is contrary to the rules. The use of bidding boxes is also encumbered with the chance that a bidder will take the wrong bid card from the box and therewith make a bid that is different to the bid intended. There is also a need of simplifying the manual handling of bids and registration of the bidding.

The object of the present invention is to provide a bridge bidding device which will fulfil these requirements.

SUMMARY OF THE INVENTION

This object is achieved in accordance with the invention with a device for controlling, presenting and registering bidding in a game of bridge, said device being characterized by a computer unit which includes at least one keyboard by means of which bids can be inserted into the computer, means for comparing the inserted bid with bids permitted by the bridge rules, means for preventing the presentation of non-permitted bids, means for registering bids entered into the computer, and means for displaying the entered bid. Such a device reduces the manual handling of cards in the bidding process, since no bid cards need be taken from the bidding box or sorted therein, and the use of a computer unit enables only those bids that are permitted by the rules to be presented or displayed, by virtue of the computer unit being programmed to check that an entered bid is permitted by the rules before displaying the bid. The use of a computer unit also enables bidding to be registered automatically.

In a preferred embodiment of the invention, the device also includes means for writing in and registering the result of the bidding, e.g. the contract reached. The computer unit preferably includes four bid-entering keyboards which are mutually coupled so that mutually sequential bids can only be entered on mutually sequential keyboards, wherein the bid display means conveniently comprise means for marking those keys on the keyboards that correspond to the bid concerned. This marking conveniently has the form of key illumination.

BRIEF DESCRIPTION OF THE DRAWINGS

The invention will now be described with reference to the accompanying drawing, in which.

DETAILED DESCRIPTIONS OF THE DRAWINGS

Figure 1:
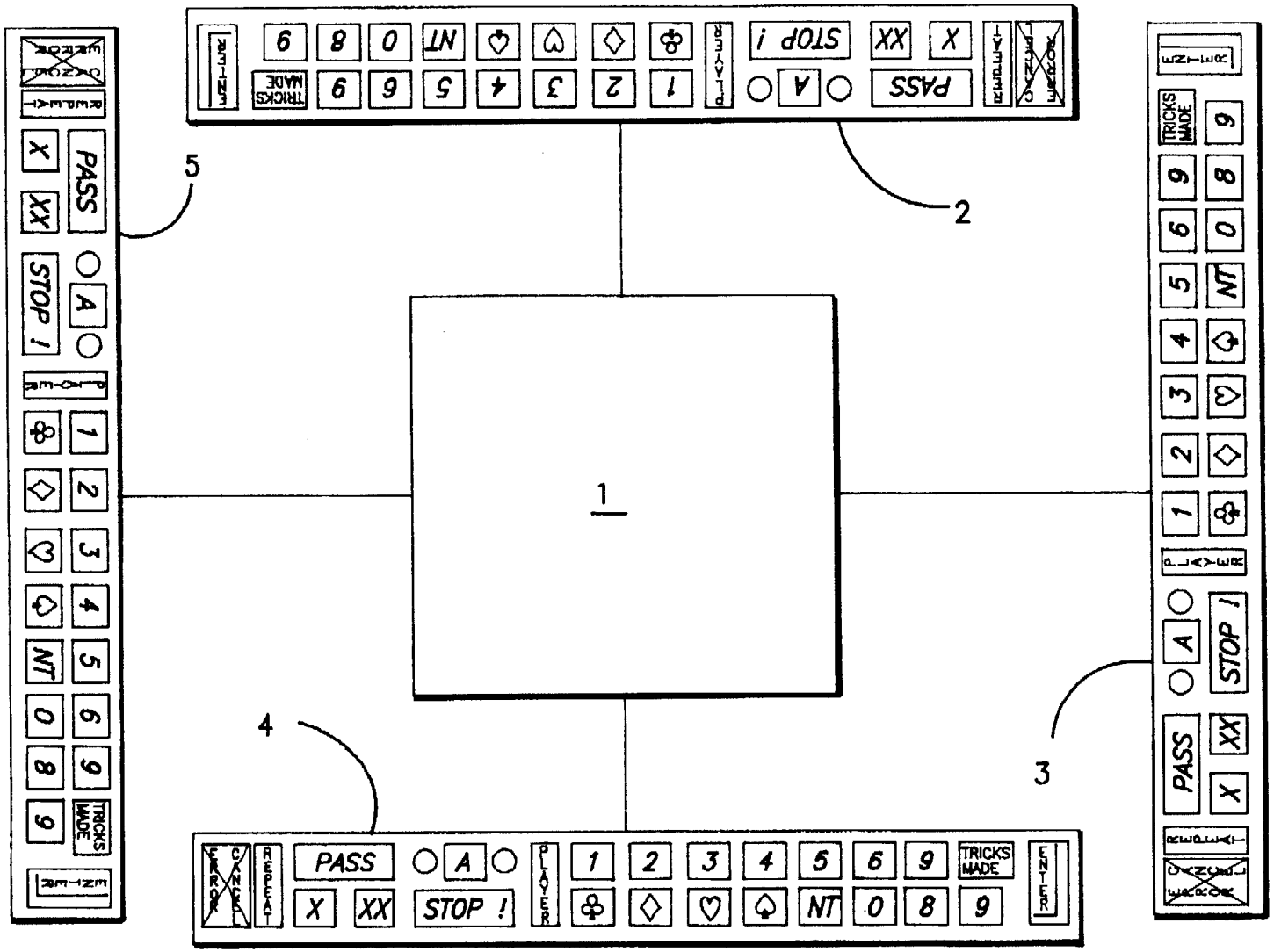
FIG. 1 illustrates schematically an exemplifying embodiment of an inventive bidding device.
Figure 2:
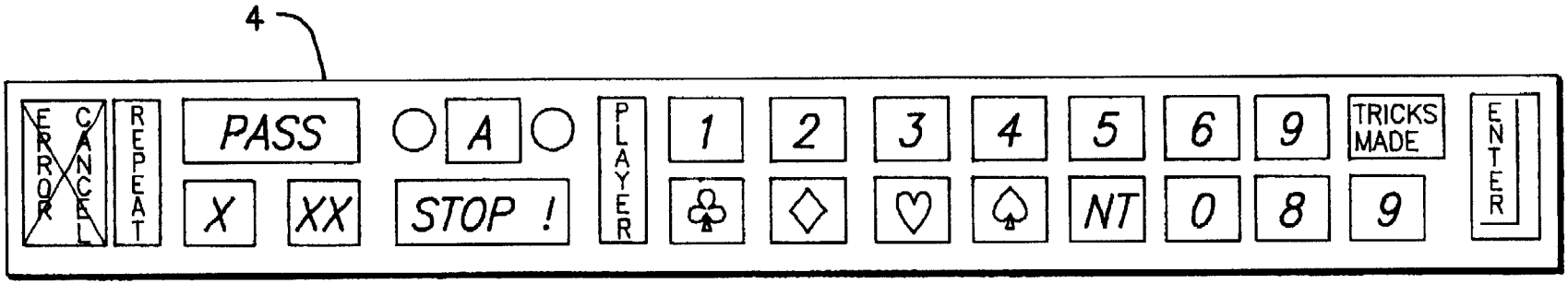
FIG. 2 illustrates schematically a keyboard included in the bidding device shown in FIG. 1.

The bridge bidding device illustrated in FIGS. 1 and 2 includes a processor 1 and four identically constructed keyboards 2–5 connected to the processor. FIG. 2 shows the keyboard 4 in larger scale than the FIG. 1 illustration and it will be seen from FIG. 2 that the keyboards 2–5 include seven digit keys with numbers 1–7 for indicating the level of bidding, and five other keys for indicating the suit bid, i.e. clubs, diamonds, hearts, spades or no trumps. The keyboards also have a PASS-key which indicates that bidding shall pass to the next player in turn, an X-key for doubling a bid, and an XX-key for redoubling. The keyboard further includes two communication keys A and STOP! indicating respectively that an unnatural bid has been made and that an opponent has been prevented from bidding for a given period of time. The keyboards also include an ENTER-key for entering a bid, a CANCEL-key, and a TRICKS MADE-key for entering the number of tricks upon completion of the bidding.

All keys, with the exception of the CANCEL-key are provided with means for lighting-up the keys upon receipt of a command from the processor 1. The processor is also programmed to indicate the player who is next to bid, i.e. indicates the keyboard from which the bid shall be given. This can be effected, for instance, by illuminating the ENTER-key on the keyboard that is next in turn. When the player thereafter presses a digit key and a suit key, these keys are illuminated, optionally with an intermittent or flashing light. The player can now check that the keyboard indicates his/her intended bid and confirms that the bid is the intended bid by pressing the ENTER-key. On the other hand, if the bid is not the intended bid, the player presses the CANCEL-key and thereafter presses the correct digit key and colour key. When the player has confirmed his/her bid by pressing ENTER, illumination of the ENTER-KEY is switched off and the bid is registered in the processor. The processor is programmed to check whether or not the entered and registered bid is permitted according to the bridge rules, by comparing the bid with the immediate preceding substantive bid, i.e. a PASS bid or bids is/are ignored by the processor when making this comparison. The processor is also programmed not to accept entered bids which are lower than or equal to the nearest preceding substantive bid, and the ENTER-key on the keyboard of the player concerned is re-illuminated to indicate that she/he has entered an unacceptable bid. If the entered and registered bid is permissible, the processor illuminates those keys which correspond to this bid on the keyboards of the three remaining players and, at the same time, illuminates the ENTER-key on the keyboard of the player whose turn it is to bid. When this player presses one of the bidding keys, illumination of those keys that showed the nearest preceding bid is switched off on all four keyboards, whereafter bidding continues in the same way as that described above with regard to preceding bids.

The keyboards of the illustrated embodiment also include a REPEAT-key which enables entered bids to be repeated. The processor is programmed to illustrate the earlier bidding when this key is pressed, e.g. to illustrate the bidding sequence for a given period of time, for instance one-half second with each bid that is entered.

After the processor has registered that the bidding has ended, i.e. when three players each press their PASS-keys in succession, the processor ignores all key depressions with the exception of registering the result. Thus, if a key should be pressed unintentionally by a player, this will not affect the final bid registered by the processor.

In the described embodiment, the keyboards also include the digit keys "0", "8" and "9" which enable a score sheet to be established electronically, by the player who has been elected to keep the score sheet (normally NORTH) pressing the digit key that corresponds to the number of tricks made and the TRICKS MADE-key at the same time, upon completion of the round. Corresponding keys on the keyboards of the other players are then illuminated by the processor while, at the same time, the ENTER-key is illuminated on the keyboard of the player who has been selected to adjust the score card (normally EAST). When the result of the deal has been confirmed, by said player pressing his/her illuminated ENTER-key, the result is registered and stored in the processor, whereafter the device is ready to process the bidding of the next deal.

The aforedescribed device can also be used to provide opponents with information recommended by the bridge rules. For instance, the A-key can be pressed to draw opponents' attention to the fact that an unnatural bid is made or has been made, wherein corresponding A-keys are illuminated on the keyboards of the other players, or an opponent player is stopped from bidding for a given period of time by pressing the STOP!-key, wherein the corresponding key of the next player in turn to bid is illuminated, and the processor is programmed so as not to accept any form of bid for a given period of time. The processor may also be programmed to initiate such a stop function automatically when a bidder makes a jump bid, i.e. a bid in which the trick level is raised at least two levels in comparison with an immediate preceding bid.

The processor 1 may be embodied physically in one of the keyboards or may be housed in its own casing. The processor 1 need not be embodied physically in the same keyboard as the keyboards 2–5, but may be a central unit to which all keyboards of all players are connected. This central unit will conveniently store continuously all results from the various tables and the relative positions of the competitors in the bridge competition can be calculated and displayed after each game. This eliminates the need of printing a result sheet. When the processor 1 is comprised of a keyboard unit, the processor will conveniently be connected to a central unit.

It may also be convenient to program the processor so that bidding is not displayed until the players or pairs of players have identified themselves, e.g. by entering their playing numbers on their respective keyboards. In this regard, the keyboard may conveniently be programmed to mark the position or place of each player prior to bidding commencing. In the described embodiment, the keyboards are provided with the additional key PLAYER so as to permit this function.

The term "key" is intended to include all types of finger-operated contact means or touch means used in "keyboards", keypads or like devices.

It will be understood that the described and illustrated embodiment can be modified in many ways within the scope of the invention. For instance, those keys that are not required to register and present the bidding may be omitted and the remaining keys arranged in another way. The keyboards may also be provided with a separate display on which bids are presented, or a display may be placed centrally on the bridge table to this end. Furthermore, separate lights may be provided for indicating the player next in turn to bid or to draw the player's attention to the fact that prescribed rules are given. When a new bid is made, this bid can be shown for a given period of time by flashing the keys concerned or by a flashing display. Although preferred, it is not necessary for the device to include four keyboards, since it can suffice with one single keyboard that is used by all four players. The scope of the invention is therefore restricted solely by the contents of the following claims.

I claim:

1. A device for registering and presenting bidding in a game of bridge, comprising:

a computer unit which includes at least one bid-entering keyboard;

means for comparing an entered bid with bids permitted by the rules of bridge;

means for preventing presentation of impermissible bids;

means for registering entered bids; and means for presenting or displaying the entered bid.

2. A device according to claim 1, further comprising means for entering and registering a bidding result.

3. A device according to claim 1, wherein the computer unit includes four bid-entering keyboards which are mutually coupled such that mutually sequential bids can only be entered on mutually sequential keyboards.

4. A device according to claim 3, wherein the means for presenting the entered bid comprise means for marking those keys on the keyboards that correspond to the bid.

5. A device according to claim 4, wherein the means for displaying the entered bid comprise key illuminating means.

* * * * *

UNITED STATES PATENT AND TRADEMARK OFFICE

CERTIFICATE OF CORRECTION

PATENT NO. : 5,743,797

DATED : April 28, 1998

INVENTOR(S) : Per JANNERSTEN

It is certified that error appears in the above-indentified patent and that said Letters Patent is hereby corrected as shown below:

On the title page, add the foreign priority data, Item [30], as follows:

--May 31, 1995 [SE] Sweden.....9502000 --.

Signed and Sealed this

Twenty-third Day of June, 1998

*Attest:*

*Attesting Officer*

BRUCE LEHMAN

*Commissioner of Patents and Trademarks*